US011083358B1

(12) United States Patent
Yang

(10) Patent No.: US 11,083,358 B1
(45) Date of Patent: Aug. 10, 2021

(54) FLOOR CLEANING DEVICE

(71) Applicant: Binghui Yang, Guangdong (CN)

(72) Inventor: Binghui Yang, Guangdong (CN)

( * ) Notice: Subject to any disclaimer, the term of this patent is extended or adjusted under 35 U.S.C. 154(b) by 0 days.

(21) Appl. No.: 16/893,361

(22) Filed: Jun. 4, 2020

(30) Foreign Application Priority Data

Apr. 28, 2020 (CN) ..... 202010347707.5

(51) Int. Cl.

| | |
|---|---|
| ***A47L 11/00*** | (2006.01) |
| ***A47L 13/17*** | (2006.01) |
| ***B08B 1/00*** | (2006.01) |
| ***A47L 13/14*** | (2006.01) |
| ***A47L 11/40*** | (2006.01) |

(52) U.S. Cl.
CPC ..... *A47L 13/17* (2013.01); *A47L 11/00* (2013.01); *A47L 11/4047* (2013.01); *A47L 13/14* (2013.01); *B08B 1/002* (2013.01)

(58) Field of Classification Search
CPC ..... A47L 13/17; A47L 13/14; A47L 13/11; A47L 11/29; A47L 11/00; A47L 11/4047; A47L 11/4016
USPC ..... 15/98, 99, 51, 52
See application file for complete search history.

(56) References Cited

U.S. PATENT DOCUMENTS

| | | | | |
|---|---|---|---|---|
| 2,297,107 | A * | 9/1942 | Magnuson | A47L 11/29 15/99 |
| 2,601,690 | A * | 7/1952 | Georgas | A47L 11/4069 15/99 |
| 2013/0081652 | A1* | 4/2013 | Falk | A47L 1/02 134/6 |
| 2014/0130292 | A1* | 5/2014 | Pedlar | A47L 11/4027 15/320 |
| 2015/0223664 | A1 | 8/2015 | Zorzo | |

FOREIGN PATENT DOCUMENTS

| | | | | |
|---|---|---|---|---|
| CN | 202681846 | U | 1/2013 | |
| CN | 107661072 | A | 2/2018 | |
| EP | 0174294 | A2 * | 3/1986 | B08B 1/008 |
| EP | 1027855 | A3 | 11/2000 | |

* cited by examiner

*Primary Examiner* — Shay Karls

(57) ABSTRACT

Disclosed is a floor cleaning device, including a water tank; a cleaning cloth wrapped around the water tank; a plurality of support shafts and a plurality of transmission shafts which are respectively provided in the water tank to support the cleaning cloth; a driving mechanism connected to the transmission shafts to drive the cleaning cloth to move circularly in the water tank; and a cleaning mechanism provided above the cleaning cloth to remove dirts on the surface of the cleaning cloth. The disclosure achieves a self cleaning at the same time of the floor cleaning, so that there is no need for the user to wash the used cleaning cloth or change a disposable cloth after the floor cleaning, realizing a true cleaning without producing the secondary pollution.

8 Claims, 3 Drawing Sheets

FLOOR CLEANING DEVICE

CROSS-REFERENCE TO RELATED APPLICATION

This application claims the benefit of priority from Chinese Patent Application No. 202010347707.5, filed on Apr. 28, 2020. The content of the aforementioned application, including any intervening amendments thereto, is incorporated herein by reference in its entirety.

TECHNICAL FIELD

This application relates to cleaning devices, and more particularly to a floor cleaning device.

BACKGROUND OF THE INVENTION

The living standards and conditions for people have been well improved with the development of science and technology, and in our daily life, the floor cleaning is important to the working and living environment.

However, the existing floor cleaners have some defects; for example, the cleaning effect still needs to be improved, and the floor cleaners cannot clean themselves automatically. The main problem is that the secondary pollution will be generated after the cleaning of floors, because the used cloth must be cleaned manually. Therefore, the existing intelligent cleaning products are disappointing in some respects.

SUMMARY OF THE INVENTION

It is necessary to provide a floor cleaning device to achieve a self cleaning at work, so that there is no need for the user to wash the used cloth or replace the disposable cloth after floor cleaning, so as to achieve a complete cleaning without secondary pollution.

The present invention provides a floor cleaning device, comprising:

a water tank;

a cleaning cloth wrapped around the water tank;

a plurality of support shafts and a plurality of transmission shafts which are respectively provided in the water tank to support the cleaning cloth, wherein the transmission shafts are configured to support and transfer the cleaning cloth, and the support shafts are configured to press the cleaning cloth so as to soak the cleaning cloth in a cleaning solution in the water tank;

a driving mechanism connected to the transmission shafts to drive the cleaning cloth to move circularly in the water tank; and a cleaning mechanism provided above the cleaning cloth to remove dirts on a surface of the cleaning cloth.

In some embodiments, the floor cleaning device further comprises a squeezing bar provided at one side of the transmission shafts to squeeze the clean cloth.

In some embodiments, the driving mechanism comprises a motor.

In some embodiments, the cleaning mechanism comprises a cleaning brush, and the cleaning brush is in contact with a surface of the cleaning cloth.

In some embodiments, the cleaning mechanism is located at a center of the cleaning cloth.

In some embodiments, a toothed belt is provided at a side where the cleaning cloth and the transmission shafts are in contact, and a notch corresponding to the toothed belt is respectively provided at both sides of each of the transmission shafts.

In some embodiments, the cleaning cloth is fitted in a bottom of the water tank, and the cleaning cloth protrudes from a surface of the water tank.

In some embodiments, the squeezing bar, the transmission shafts and the water tank are connected through bearings.

In some embodiments, the water tank comprises a waste water tank and a clear water tank.

In some embodiments, the water tank is detachable or is integratedly formed with the floor cleaning device.

The floor cleaning device of the present invention has the following beneficial effects.

The floor cleaning device is capable of washing the cleaning cloth automatically at the same time of the floor cleaning, so that there is no need for the user to wash the used cloth or replace the used disposable cloth after the floor cleaning, allowing for self-cleaning.

BRIEF DESCRIPTION OF THE DRAWINGS

The embodiments of the invention will be more clearly described below with reference to the accompanying drawings. Obviously, described below are merely some examples of the invention, and various variations and modifications can be made by those skilled in the art without departing from the spirit and scope of the invention.

DETAILED DESCRIPTION OF EMBODIMENTS

Figure 1:
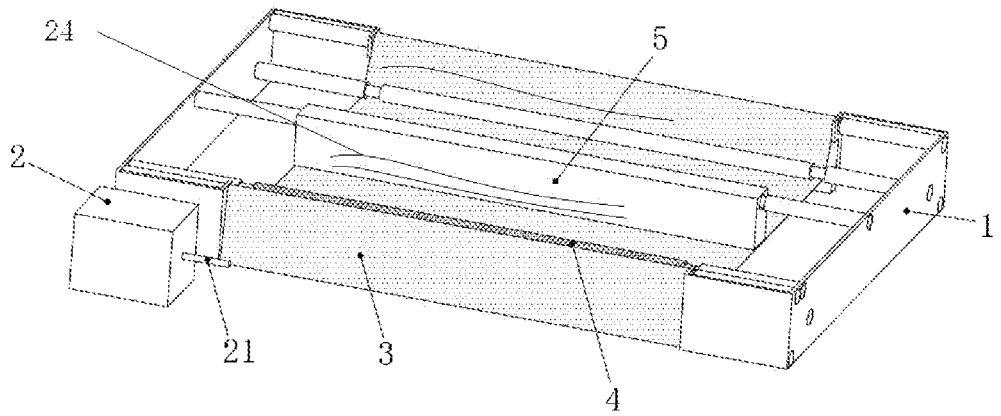
FIG. 1 is a schematic diagram of a floor cleaning device according to Embodiment 1 of the present invention.

The technical solutions of the embodiments of the present invention will be clearly and fully described with reference to the accompanying drawings. However, the invention may be implemented in various modes and is not limited to the embodiments described herein. It should be noted that various variations and modifications of the invention made by those skilled in the art without departing from the spirit and scope of the invention should fall within the scope of the invention.

It should be noted that all directional terms in the embodiments of the invention, such as "above", "below", "left", "right", "front" and "rear", are merely illustrative for relative positions and movement conditions between different parts at a certain posture (as shown in the drawings). If the posture has been changed, the directional instructions should also be changed therewith.

Moreover, terms such as "first" and "second" are only used for illustration, and should not be interpreted as indication or implication of relative importance or the number of the technical features. Therefore, a feature defined by "first" or "second" can indicate or imply one or more features. Besides, the term "and/or" used herein includes three conditions. For example, "A and/or B" refers to A, or B, or both A and B. In addition, technical solutions of embodiments can be combined based on practical implementation by those skilled in the art.

Embodiment 1

As shown in FIGS. 1-4, the invention provides a floor cleaning device, including: a water tank 1, a cleaning cloth 3, a driving mechanism 2 and a cleaning mechanism 5.

The water tank 1 is configured to fill a cleaning solution 24. The cleaning cloth 3 is wrapped around the water tank 1 and in contact with an outer side wall of the water tank 1. A plurality of support shafts and a plurality of transmission shafts are respectively provided at an inner side of the water tank 1 to support the cleaning cloth 3. The support shafts are respectively provided at both sides of the bottom of the water tank 1 to restrain the moving track of the cleaning cloth 3, so that the cleaning cloth 3 is constantly drowned in the cleaning solution 24 when moving in the water tank 1, promoting to diffuse dirts on the surface of the cleaning cloth 3 in the cleaning solution 24 to prepare for a next cleaning. The cleaning mechanism 5 is provided above the cleaning cloth 3 and in contact with the cleaning cloth 3. When the cleaning cloth 3 moves, the cleaning mechanism 5 brushes off the surface dirts on the cleaning cloth 3, thus achieving the floor cleaning and the self cleaning simultaneously.

The water tank 1 is made of polyethylene (PE), polyethylene terephthalate (PET), polystyrene (PS), polycarbonate (PC), acrylonitrile-butadiene-styrene copolymer (ABS), or made of materials having a resistance to acid and alkali corrosion, such as polyvinyl chloride (PVC), polypropylene (PP), polyamide (PA), polyformaldehyde (POM) and modified polypropylene. The water tank 1 has a length of 2 mm-1000 mm, a width of 2 mm-1000 mm and a height of 2 mm-1000 mm.

The cleaning cloth 3 is made of a natural fiber such as cotton fabric A, wool fabric B, silk fabric C or flax fabric D, or a chemical fiber such as terylene A, nylon B, acrylic C, vinylon D, polypropylene E or polyvinyl chloride F.

As shown in FIG. 1, in this embodiment, the floor cleaning device further includes a squeezing bar 4 provided at one side of a first transmission shaft 6 to squeeze the clean cloth 3. Specifically, the squeezing bar 4 is provided at a horizontal direction of the one side of the first transmission shaft 6. When moving out from the water tank 1, the cleaning cloth 3 is squeezed by the squeezing bar 4 and the first transmission shaft 6. Meanwhile, some of the cleaning solution 24 on the cleaning cloth 3 is squeezed, and some is left on the clean cleaning cloth 3. This brings convenience to wash the floor circularly, and avoids the waste of the cleaning solution 24.

The squeezing bar 4 is made of thermoplastic elastomer (such as TPE, TPR, TPU, TPV), rubber or silica gel. Specifically, a distance between the squeezing bar 4 and the first transmission shaft 6 is 0-50 mm.

In some embodiments, to reduce the tension that the cleaning cloth 3 suffered, the squeezing bar 4, the first transmission shaft 6 and the water tank 1 are connected, for example through bearings. The squeezing bar 4 and the first transmission shaft 6 may be connected in other manners such as a telescopic manner to allow for their rotation.

It should be understood that the driving mechanism 2 can be various types of motors or gear cases. When a motor is used as the driving mechanism 2, it can be a direct current motor, an asynchronous motor or a synchronous motor.

Figure 3:
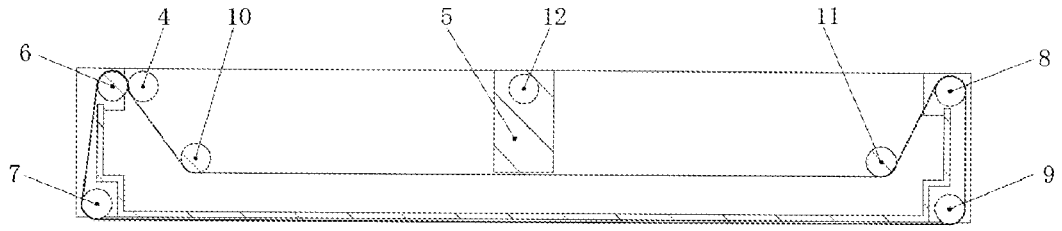
FIG. 3 is longitudinal section view of the floor cleaning device according to Embodiment 1 of the present invention.
Figure 4:
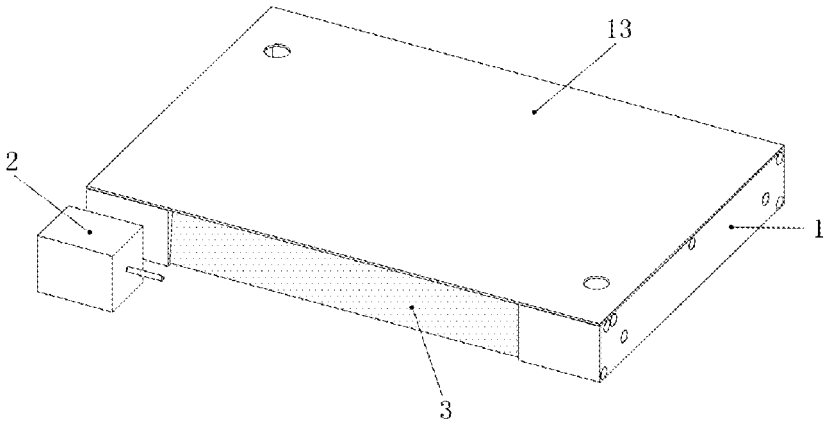
FIG. 4 schematically shows an external structure of the floor cleaning device according to Embodiment 1 of the present invention.

As shown in FIG. 3, the cleaning mechanism 5 includes a cleaning brush. It should be understood that when the floor cleaning device works, the cleaning mechanism 5 is in contact with the surface of the cleaning cloth 3 to brush off the dirts on the surface of the cleaning cloth 3 as the cleaning cloth 3 moves.

In some embodiments, the cleaning mechanism 5 is located at the center of the cleaning cloth 3. Specifically, the cleaning mechanism 5 is fixed at the inner center of the water tank 1 via a support rod 12, and the bottom of the cleaning mechanism 5 is in contact with the surface of the cleaning cloth 3. Meanwhile, the cleaning mechanism 5 is just located at the center of the cleaning cloth 3 in the water tank 1. When entering the water tank 1, the cleaning cloth 3 is in contact with the cleaning solution 24 at first to dissolve dirts on the cleaning cloth 3 to improve the cleaning efficiency and effect of the cleaning mechanism 5. At the same time, after a cleaning, the cleaning cloth 3 can move in the cleaning solution 24 for further cleaning. In this way, the cleaning cloth 3 becomes cleaner which in turn makes the floor much cleaner. Besides, a larger gap is left between the cleaned cleaning cloth 3 and the first transmission shaft 6 to provide a larger tension, which reduces the damage to the cleaning cloth 3 when the floor cleaning device is broken down and helps to prolong the service life of the floor cleaning device.

In this invention, the cleaning mechanism 5 is made of terylene A, nylon B, acrylic C, vinylon D, polypropylene E, polyvinyl chloride F, ceramic G, metal H or alloy.

Figure 6:
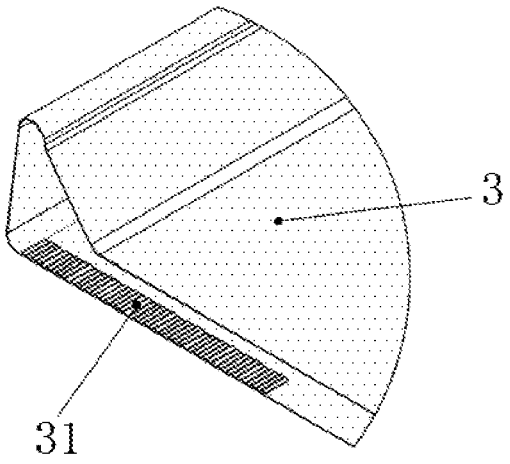
FIG. 6 is a partial view of a cleaning cloth of the floor cleaning device according to the present invention.

As shown in FIG. 6, a toothed belt 31 is provided at one side where the cleaning cloth 3 and the first transmission shaft 6 are in contact. To drive the cleaning cloth 3 better, a notch corresponding to the toothed belt 31 is respectively provided at both sides of each of the first transmission shaft 6.

Correspondingly, the side where the cleaning cloth 3 and the first transmission shaft 6 are in contact can also be a rough synchronizing belt to rotate.

In some embodiments, an output end of the driving mechanism 2 is combined with an inner side of the cleaning cloth 3 to control the rotating speed of the cleaning cloth 3 and the contact force with the floor. It should be noted that when a gear case is used as the driving mechanism 2, the specific structure and size of the gear is not limited, but a rotary speed formed by a combination of the gear case and the cleaning cloth 3 has a range of 0.01 m/s-100 m/s.

As shown in FIG. 3, the cleaning cloth 3 is fitted in the bottom of the water tank 1, and the cleaning cloth 3 protrudes from the surface of the water tank 1. Specifically, a protruded height of the cleaning cloth 3 is 0.1 mm-2 mm. In this embodiment, a friction force is generated between the water tank 1 and the surface that the cleaning cloth 3 is in contact with the floor to clean the floor, and the friction force is 0.1 N-1000 N.

Embodiment 2

Figure 5:
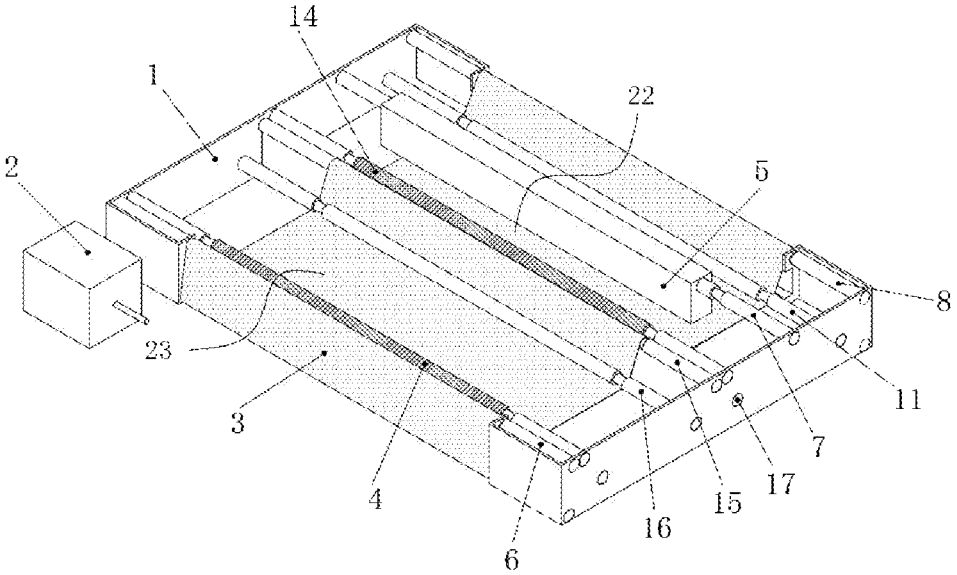
FIG. 5 is a schematic diagram of the floor cleaning device according to Embodiment 2 of the present invention.

As shown in FIG. 5, different from Embodiment 1, the water tank 1 in this embodiment is divided into a waste water tank 22 and a clear water tank 23 to improve the cleaning of the floor and the cleaning cloth 3. Correspondingly, additional squeezing bars, support shafts and transmission shafts are needed. In this embodiment, the cleaning cloth 3 can be first cleaned in the waste water tank 22, and further cleaned in the clear water tank 23. After the cleaning, the cleaning cloth 3 is cleaner and will provide a better cleaning for the floors.

It should be noted that the water tank 1 and the driving mechanism 2 can be arranged in the following two modes:

1) the water tank 1, the driving mechanism 2 and an extended part of the water tank 1 form an integrated module; 2) the water tank 1 is detachable and separated from the driving mechanism 2. Due to different floor structures, different floors should be cleaned by different types of cleaners. Using the second mode, different cleaning cloths 3 may be chosen according to different floors, and several water tanks 1 can be respectively provided with different cleaning cloths 3. It saves the cost to change water tanks 1 for different floors.

It should also be noted that a disinfectant can be added in the water tank 1 to clean and sterilize the floor all around, and the materials for the water tank are resistant to acid and alkali.

Figure 2:
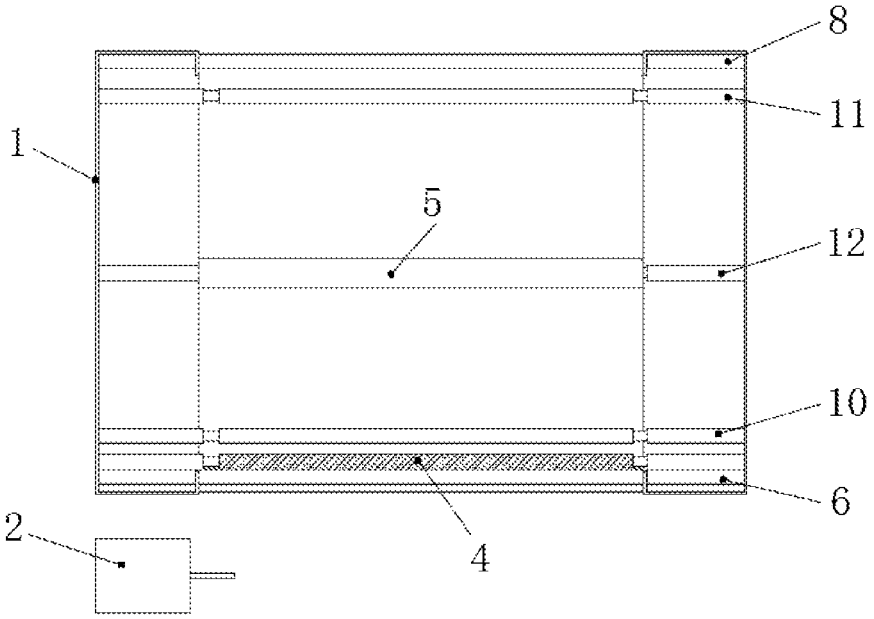
FIG. 2 is a top view of the floor cleaning device according to Embodiment 1 of the present invention.

As shown in FIGS. 2 and 3, in this embodiment, the floor cleaning device is provided at the bottom of a cleaning device such as handheld floor cleaning device, intelligent sweeper and industrial sweeper. A rear cover 13 is provided on the water tank 1. When the cleaning device operates a cleaning, the driving mechanism 2 is energized to drive the cleaning cloth 3 and a plurality of transmission shafts for a circular operation of the cleaning cloth 3 at outer and inner sides of the water tank 1. During the cleaning, the cleaning cloth 3 successively bypasses a first transmission shaft 6, a second transmission shaft 7, a fourth transmission shaft 9 and a third transmission shaft 8. One side of the cleaning cloth 3 is in contact with the floor to clean the floor. Then the cleaning cloth 3 is transferred in the water tank 1, and is soaked in the cleaning solution 24 under pressing by a support shaft 10 and a second support shaft 11 to be. Next, the cleaning cloth 3 is cleaned by the cleaning mechanism 5 to remove dirts brought from the floor. A part of dirty water is squeezed by a first squeezing bar 4 and the first transmission shaft 6, so that the cleaning cloth 3 is clean and moist when leaving the water tank 1. Then the cleaning cloth 3 is transferred to the bottom of the water tank 1 via the transmission shafts to be in contact with the floor for a circular cleaning of the floor.

As shown in FIG. 5, in this embodiment, the water tank 1 is divided into the waste water tank 22 and the clear water tank 23. At the same time, a second squeezing bar 14, a fifth transmission shaft 15, a third support shaft 16 and a fourth support shaft 17 are provided additionally. In the waste water tank 22, the dirty water on the cleaning cloth 3 is squeezed by the second squeezing bar 14 and the fifth transmission shaft 15 and is left in the waste water tank 22, thus reducing the pollution to the cleaning solution 24 in the clear water tank 23, and improving the cleaning of the floor and the cleaning cloth 3.

It should be understood that the water tank 1 is divided into the waste water tank 22 and the clear water tank 23 to improve the cleaning effect.

It should be understood that in this embodiment, water inlet and outlet should be provided on the water tank 1, and locations of the water inlet and outlet are not limited.

The above are only some preferred embodiments of the present invention, and are not intended to limit the present invention. Any modifications, equivalent substitutions and improvements within the spirit and principle of the present invention, or direct or indirect applications of the invention in other related fields shall fall into the scope of the present invention.

What is claimed is:

1. A floor cleaning device, comprising:

a water tank;

a cleaning cloth wrapped around the water tank;

a plurality of transmission shafts which are configured to support and transfer the cleaning cloth, wherein two ends of each transmission shaft are connected to the water tank;

a plurality of support shafts which are provided at two sides of a bottom of an interior of the water tank and are configured to support the cleaning cloth and press the cleaning cloth so as to soak the cleaning cloth in the water tank;

a driving mechanism connected to the transmission shafts to drive the cleaning cloth to move circularly in the water tank;

a cleaning mechanism provided above the cleaning cloth to remove dirts on a surface of the cleaning cloth;

a toothed belt provided on a side of the cleaning cloth in contact with the transmission shafts;

the floor cleaning device further comprises a squeezing bar provided at one side of the transmission shafts to squeeze the cleaning cloth, wherein the squeezing bar is rod-shaped; and two circular ends of the squeezing bar are connected to the water tank; and the water tank comprises a waste water tank and a clear water tank through which the cleaning cloth passes in sequence.

2. The floor cleaning device of claim 1, wherein the driving mechanism comprises a motor.

3. The floor cleaning device of claim 1, wherein the cleaning mechanism comprises a cleaning brush, and the cleaning brush is in contact with the surface of the cleaning cloth.

4. The floor cleaning device of claim 3, wherein the cleaning mechanism is located at a center of the cleaning cloth.

5. The floor cleaning device of claim 1, wherein a notch corresponding to the toothed belt is respectively provided at both sides of each of the transmission shafts.

6. The floor cleaning device of claim 1, wherein the cleaning cloth is fitted in a bottom of the water tank, and the cleaning cloth protrudes from a surface of the water tank.

7. The floor cleaning device of claim 1, wherein the squeezing bar, the transmission shafts and the water tank are connected through bearings.

8. The floor cleaning device of claim 1, wherein the water tank is detachable or is integratedly formed with the floor cleaning device.

* * * * *